US005131857A

United States Patent [19]

Gmelin et al.

[11] Patent Number: 5,131,857

[45] Date of Patent: Jul. 21, 1992

[54] POWER STRIP FOR SUPPLYING ELECTRICAL POWER IN COMMON TO A PLURALITY OF ELECTRICALLY ACTUATABLE UNITS OF INTERNAL COMBUSTION ENGINES

[75] Inventors: Karl Gmelin, Flein; Thomas Naeger, Stuttgart; Klaus-Juergen Peters, Affalterbach-Birkhau; Wolfgang Schaefer, Grossbottwar; Manfred Scheible, Hemmingen, all of Fed. Rep. of Germany

[73] Assignee: Robert Bosch GmbH, Stuttgart, Fed. Rep. of Germany

[21] Appl. No.: 760,664

[22] Filed: Sep. 16, 1991

[30] Foreign Application Priority Data

Sep. 26, 1990 [DE] Fed. Rep. of Germany ..... 4030422

[51] Int. Cl.[5] ..... H01R 13/514

[52] U.S. Cl. ..... 439/130; 439/248; 123/456

[58] Field of Search ..... 439/34, 130, 248; 123/456, 470

[56] References Cited

U.S. PATENT DOCUMENTS

| | | | |
|---|---|---|---|
| 4,857,003 | 8/1989 | Hafner et al. | 439/130 |
| 5,030,116 | 7/1991 | Sakai et al. | 439/130 |
| 5,044,338 | 9/1991 | Shelton | 123/456 X |

*Primary Examiner*—Eugene F. Desmond

*Attorney, Agent, or Firm*—Edwin E. Greigg; Ronald E. Greigg

[57] ABSTRACT

A power strip including plug housings, in which first contact elements can be connected to second contact elements of an electrically actuatable unit. The electically actuatable units are movable with play in a mounted state relative to the power strip housing. In the power strip, one damping element is disposed between each plug housing and the power strip housing, and in engine operation this damping element damps the motions of the plug housing relative to the power strip housing or of the first electrically conductive contact elements relative to the second electrically conductive contact elements, and thus prevents excessive wear at the contact elements. The embodiment of the power strip is particularly suitable for supplying electrical power jointly to electrically actuatable fuel injection valves.

25 Claims, 8 Drawing Sheets

POWER STRIP FOR SUPPLYING ELECTRICAL POWER IN COMMON TO A PLURALITY OF ELECTRICALLY ACTUATABLE UNITS OF INTERNAL COMBUSTION ENGINES

BACKGROUND OF THE INVENTION

The invention is based on a power strip as defined hereinafter. German Patent Application P 40 03 958.7 has already proposed a power strip for supplying power in common to a plurality of electrically actuatable units of internal combustion engines that are mounted in common in a fuel distributing element. On the power strip housing, plug housings with first electrically conductive contact elements are provided, which can be connected to second electrically conductive power elements of electrically actuatable units. To compensate for tolerances in shape and location between the first electrically conductive contact elements of the plug housings and the second electrically conductive contact elements of the electrically actuatable units, the plug housings are floatingly movable in the direction of their longitudinal axes and vertically to it, relative to the power strip housing, to prevent damage when the power strip is connected to the electrically actuatable units, or when the electrically actuatable units connected to one another by the power strip are mounted on the engine. The radial and axial play of the plug housings relative to the power strip housing, when the plug housings are mounted on the electrically actuatable units, means that in engine operation, the plug housings execute dynamic movements of their own relative to both the power strip and the electrically actuatable units. Because of these independent motions, the first electrically conductive contact elements, secured in the plug housings by being clipped into place, are also moved relative to the second electrically conductive contact elements of the electrically actuatable units. The result of this procedure is the danger of excessive wear at the contact faces of the first electrically conductive contact elements and the second electrically conductive contact elements, which can cause the premature failure of the component assembly comprising the power strip and the electrically actuatable units.

OBJECT AND SUMMARY OF THE INVENTION

The power strip according to the invention has an advantage over the prior art of enabling effective damping of the dynamic independent motions of the various plug housings relative to the power strip housing and relative to the electrically actuatable units, and thus of the motions of the second electrically conductive contact elements of the electrically actuatable units relative to the first electrically conductive contact elements of the plug housing that cooperate with the second electrically conductive contact elements. The result is particularly low wear of the first electrically conductive contact elements and second electrically conductive contact elements in the vicinity of the contact points. At the same time, the damping elements of the power strip according to the invention allow mobility of the plug housings when the power strip is mounted on the electrically actuatable units, or when the electrically actuatable units connected to one another by the power strip are mounted on the engine, so that it is no problem to compensate for tolerances in shape and in location, and low-force joining is also possible.

A power strip having the characteristics set forth herein enables supplying electrical power in common to fuel injection valves disposed in a fuel distributing element, with the same advantages as discussed above. The dynamic independent motions between the first electrically conductive contact elements of the plug housings and the second electrically conductive contact elements of the fuel injection valves during engine operation are effectively damped, resulting in especially low wear of the first electrically conductive contact elements and second electrically conductive contact elements in the region of their contact point.

A power strip as set forth makes the advantages discussed possible, but furthermore, the dynamic independent motions between the first electrically conductive contact elements of the plug housings and the second electrically conductive contact elements of the electrically actuatable units during engine operation are particularly effectively damped, and the power strip is distinguished by a simple structure.

Advantageous further features of and improvements to the power strip disclosed herein are attainable with the characteristics recited in the disclosure.

For a particularly simple embodiment of the power strip according to the invention, it is advantageous if one damping element each is disposed between one face end of the bottom of the power strip housing oriented toward the plug housings and each face end of the various plug housings oriented toward the bottom.

However, it is also advantageous if one damping element is integrally formed onto each of the face ends of the various plug housings oriented toward the bottom of the power strip housing. This results in particularly simple mounting of the power strip according to the invention.

For a simple, economical embodiment of the power strip according to the invention, it is advantageous if one damping element each is integrally formed onto a retaining shoulder of a stepped through bore of the plug housing, the damping element cooperating with a central protuberance of the bottom of the power strip housing.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
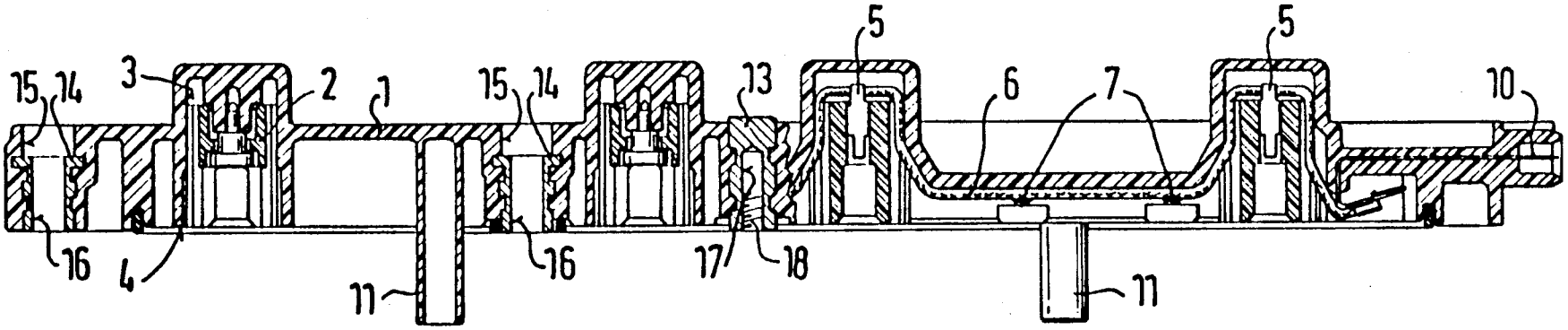
FIGS. 1 and 2 show a cross sectional view and a top view of a first exemplary embodiment of a power strip embodied according to the invention.
Figure 2:
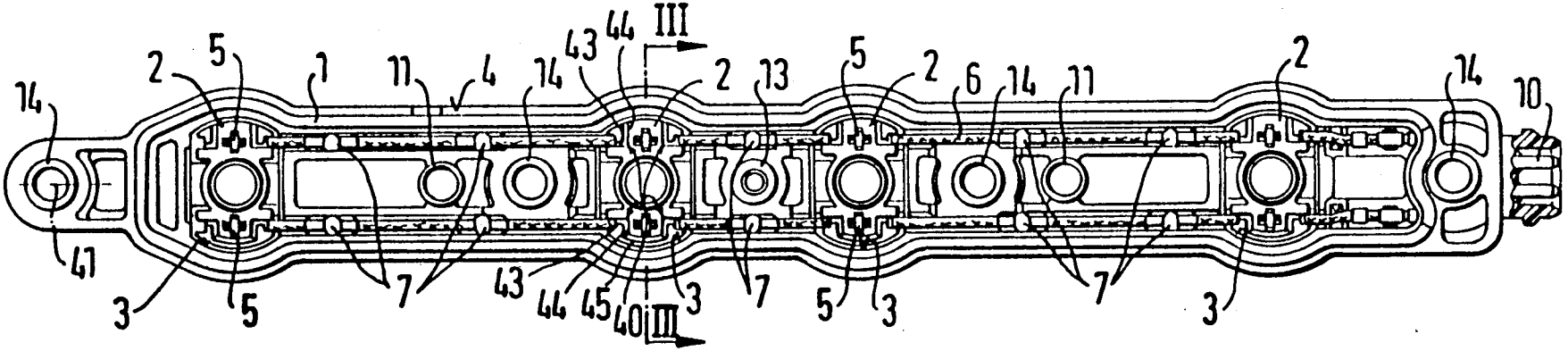

In the power strip, shown in FIGS. 1-5 by way of example, for supplying electrical power in common to a plurality of electrically actuatable units of internal combustion engines, according to a first exemplary embodiment, the power strip housing, embodied for instance as a plastic injection molded part, is identified by reference numeral 1. Plug housings 2 are disposed in the power strip housing 1, each assigned to one electrically actuatable unit and serves to supply electrical power to it. To this end, one receiving opening 3 in the form of a blind bore, which is open toward an end face 4 of the power strip, is provided in the power strip housing 1 for each plug housing 2. Disposed in the plug housing 2, which is made of electrically insulating material, are first electrically conductive contact elements 5, which are electrically conductively connected to electrical conductors 6 disposed in the power strip housing 1. The electrical conductors 6 are for instance connected to the power strip housing 1 by means of at least one support point 7 of the power strip housing 1, with one support point between each pair of receiving openings 3, and each support point 7 is formed by caulking of material of the power strip housing 1 by means of ultrasonic welding.

At one of the ends, for instance, in the longitudinal direction a connection plug 10 is also disposed on the power strip housing 1; the various electrical conductors 6 are connected to this connection plug 10, and electrical trigger signals for the electrically actuatable units can be input via this plug from an electronic control unit of a known design, not shown. Thus, all the electrical conductors 6 extend, beginning at the connection plug 10, to the various plug housing 2 within the power strip housing 1, where they branch off to the various first electrically conductive contact elements 5.

Two guide arms 11 protrude, axially spaced apart from one another, from the end face 4 of the power strip housing 1. To connect the power strip housing 1 to a fuel distributing element, intake tube or cylinder head of an internal combustion engine, by way of example, fastening bushes 13, 14 are formed into the power strip, shown as an exemplary embodiment, during manufacture; at least on their side toward the end face 4 of the power strip, these bushes are open and are for instance made of a metal material. The fastening bush 13 has a blind bore 17, which is provided with an internal thread 18, while the fastening bushes 14, open at both ends, together with openings 15 in the power strip housing 1 that are concentric with the fastening bushes 14 form fastening openings 16 in the power strip housing 1.

Figure 3:
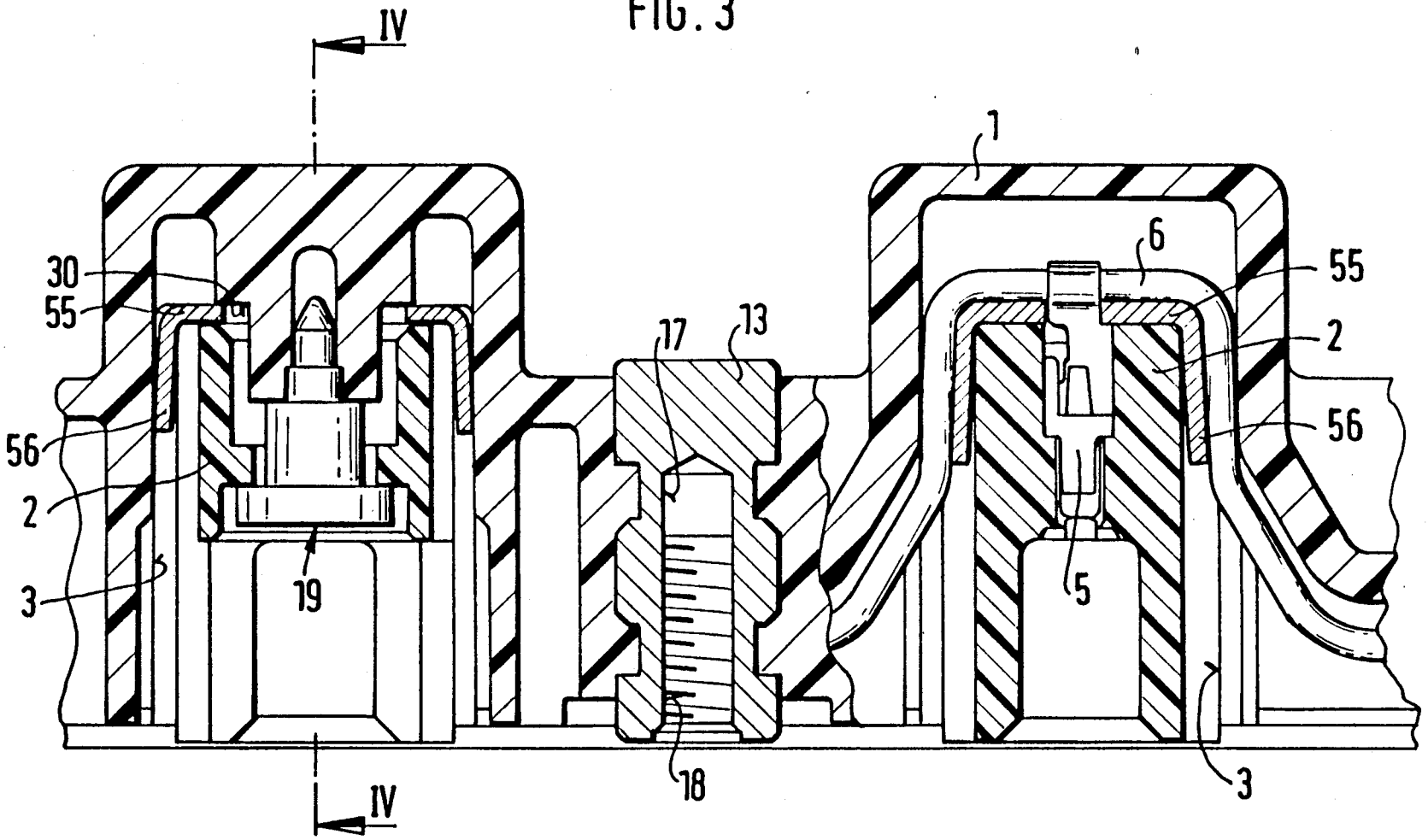
FIG. 3 shows a highly enlarged detail of a portion of FIG. 1 showing the portion of the power strip in greater detail.
Figure 4:
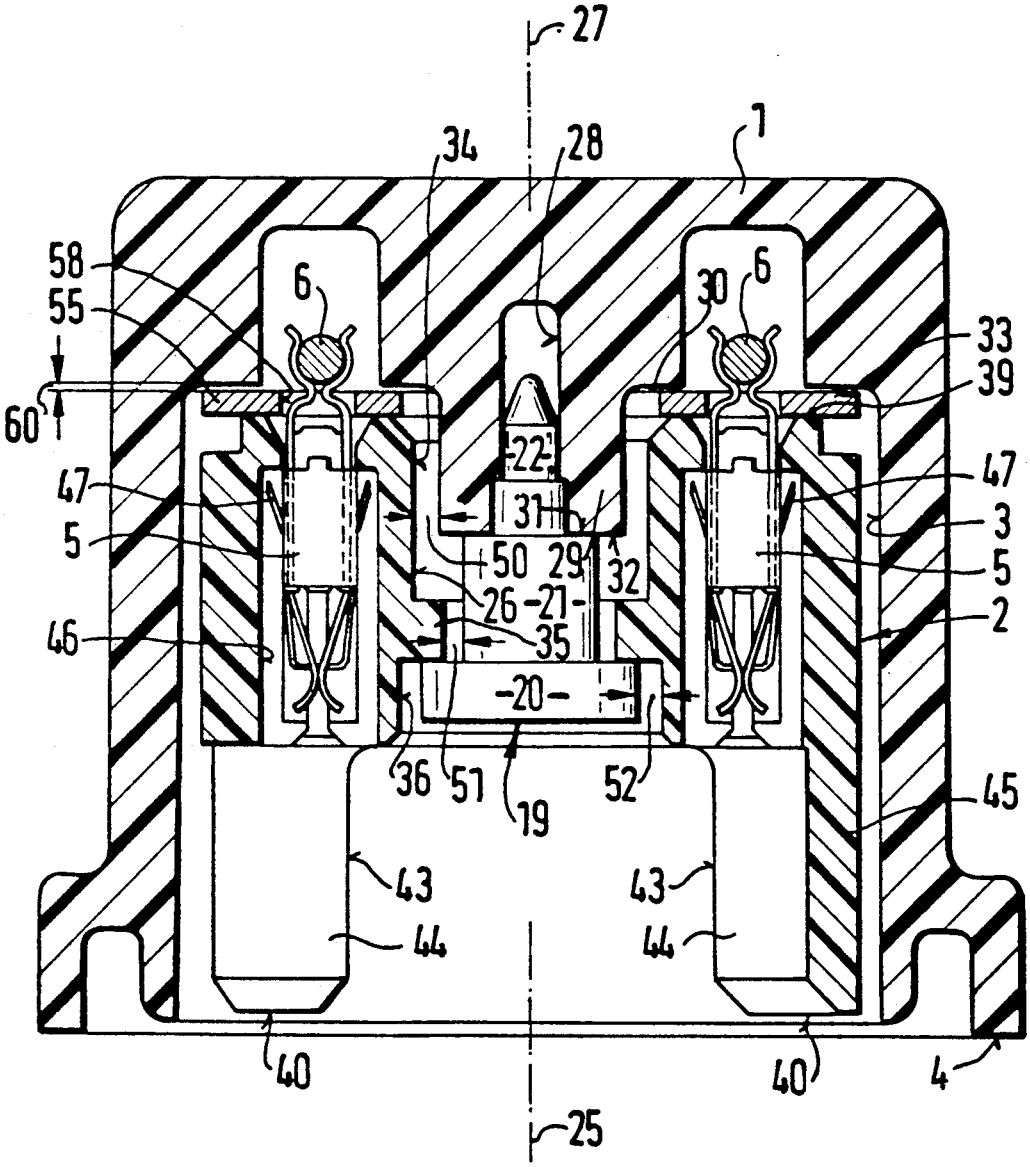
FIG. 4 is a section taken along the line IV—IV of FIG. 3.

For further explanation of the power strip according to the first exemplary embodiment, FIG. 3 provides a highly enlarged detail of FIG. 1, with the power strip partially, and FIG. 4 shows a section taken along the line 4—4 of FIG. 3.

To connect the plug housing 2, which for instance is made of plastic, to the power strip housing 1, made of plastic, a stepped retaining element 19 is used, which is for instance made of plastic. Beginning at a head 20 oriented toward the end face 4 of the power strip, the stepped retaining element 19 has a middle region 21 that has a smaller diameter than the head 20 and a tip 22, for instance stepped, which has a smaller diameter than the middle region 21. The retaining element 19 is passed through a stepped through opening 26 of the plug housing 2 that is embodied concentrically with a longitudinal axis 25 of the plug housing 2. With its tip 22, the retaining element 19 is inserted into a blind bore 28, extending concentrically with a longitudinal axis 27 of the receiving opening 3 of the power strip housing 1, in a central protuberance 29 of a bottom 30 of the power strip housing 1. The retaining element 1 is joined to the wall of the blind bore 28, for instance by means of ultrasonic welding, in such a manner that the retaining element 19 rests with a first element shoulder 31 of the middle region 21 axially on one face end 32 of the middle protuberance 29. The middle protuberance 29 protrudes axially toward the respective plug housing 2 past one end face 33 of the bottom part 30 of the power strip 1 and for instance has a cross-sectional area in the form of a circular ring. The stepped through bore 26 of the plug housing 2 has a first region 34 oriented toward the end face 33 of the bottom 30, a retaining shoulder 35 having a reduced inside diameter, and a second region 36 adjoining it, remote from the end face 33 of the bottom.

Face ends 39 of the various plug housings 2 are located opposite the face end 33 of the bottom of the power strip housing 1. On the side remote from the face end 39 of the plug housing 2, positioning noses 40, for instance four in number and having a polygonal cross-sectional shape, are integrally formed onto each plug housing 2, and are spaced apart from one another such that two of them are located on each side of a longitudinal axis 41, shown in FIG. 2, of the power strip, symmetrically with the line 4—4 in FIG. 2 that passes through the first electrically conductive contact elements 5. The positioning noses 40 are for instance in the form of a right angle and have parallel faces 43 in the longitudinal direction of the power strip housing 1 and parallel faces 44 vertically to them. A connecting rib 45 is formed on the plug housing 2 and joins the two positioning noses 40 located on one side of the longitudinal axis 41 of the power strip on their end remote from the longitudinal axis 41 of the power strip, so that the two parallel faces 44 of these noses are shorter than the parallel faces 44 extending on the other side of the longitudinal axis 41 of the power strip, which come to an end in the open at the end of the plug housing 2. With respect to the longitudinal axis 41 of the power strip housing 1, the parallel faces 44 and thus the positioning noses 40 are embodied asymmetrically to one another on different sides of the longitudinal axis 41 of the power strip.

The plug housing 2 for instance has two stepped plug openings 46 open to both sides, in each of which a first electrically conductive contact element 5 is secured with play in detent fashion, by means of detent noses 47, for instance two in number, embodied on the first electrically conductive contact element 5.

In the radial direction, a radial play 50 is provided between the stepped through bore 26 of the plug housing 2, in the first region 34 oriented toward the face end 33 of the bottom, and the circumference of the cylindrical middle protuberance 29. A radial play 51 is also provided between the inside diameter of the retaining shoulder 35 in the middle region 21 of the retaining element 19, and a radial play 52 is provided between the head 20 of the retaining element 19 and the second region 36 of the through bore 26 surrounding the head 20. As a result, the plug housing 2 is freely movable relative to the retaining element 19 and thus also relative to the power strip housing 1 in the radial and horizontal directions, at right angles to its longitudinal plug axis 25 and the longitudinal receiving axis 27, respectively.

In the axial direction of the longitudinal plug axis 25 and of the longitudinal receiving axis 27, respectively, there is one damping element 55 each, disposed between the face end 33 of the bottom of the power strip housing 1 and the face end 39 of the respective plug housing 2. The damping element 55 for instance takes the form of a slab molded from some elastic material, such as plastic or rubber. In the mounted state between the face end 33 of the bottom 30 and the face end 39 of the respective plug housing 2, as can be seen from FIG. 3, in the first exemplary embodiment of the invention the outer rim 59 of the elastic slab embodied as a damping element 55 is bent in the direction of the positioning noses 40, remote from the face end 33 of the bottom.

Figure 5:
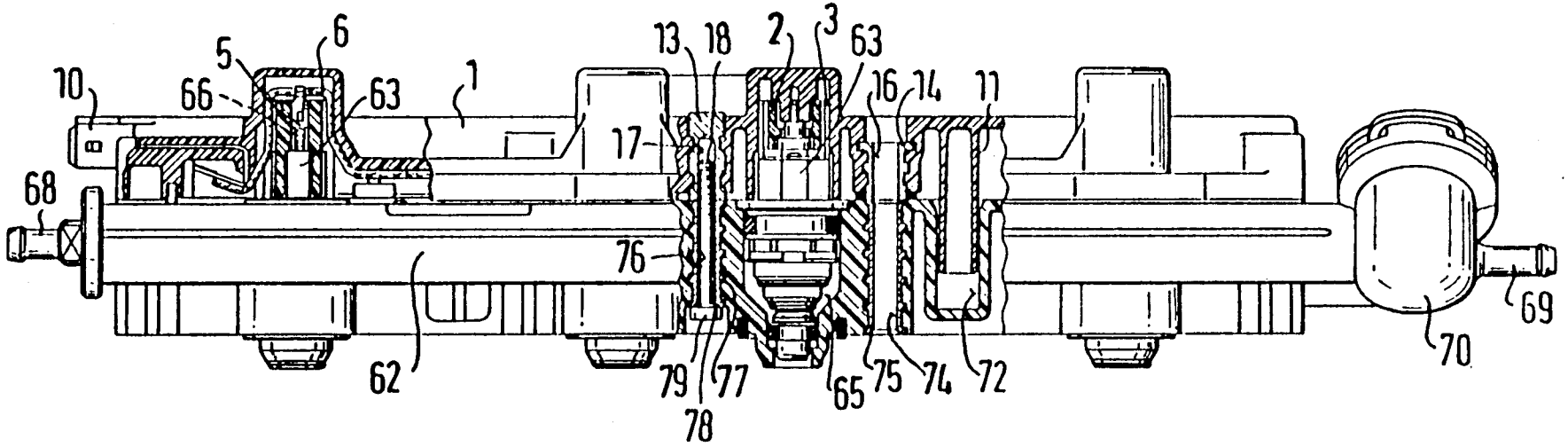
FIG. 5 shows a partial cross sectional view of a fuel distributing element with fuel injection valves disposed in it, which are supplied with electrical power in common by a power strip according to the first exemplary embodiment.

Between the damping element 55 and the face end 33 of the bottom of the power strip housing 1, and between the damping element 55 and the face end 39 of the respective plug housing 2, an axial play 60 is provided in each case. The axial play 60 and the elasticity of the elastic damping element 55 enable joining of the power strip with low force, for instance to a fuel distributing element 62 with fuel injection valves 63 disposed in it, as shown in FIG. 5.

The fuel distributing element 62 substantially corresponds to the fuel distributing element described in German Published, Non-Examined Patent Application DE-OS 37 30 571. One fuel injection valve 63 is disposed in each of stepped valve receiving openings 65, spaced apart from one another, in the fuel distributing element 62; the fuel injection valve 63 is surrounded by the valve receiving opening 65, which is open on both ends. The fuel injection valve 63 communicates with at least one fuel line extending in the fuel distributing element 62. The supply of fuel to and removal from the fuel distributing element 62 is effected by means of connection necks, for instance two in number, 68, 69 of the fuel distributing element 62. The system pressure of the fuel in the fuel distributing element 62 is regulated in a known manner by means of a pressure regulator 70 disposed on the fuel distributing element 62.

The power strip is connected to the fuel distributing element 62 in such a way that the valve receiving openings 65 are covered by it and the fuel injection valves 63 held therein. The guide arms 11 of the power strip housing 1 serve the purpose of a simple assembly of the power strip and fuel distributing element 62 and they engage assembly openings 72 of the fuel distributing element 62. Fastening openings 74 open to both sides are disposed in the fuel distributing element 62, for instance by means of fastening bushes 75 disposed in the fuel distributing element 62, concentrically with the fastening openings 16 that are open to both sides and are embodied in the power strip housing 1. By means of these openings, which extend through both the fuel distributing element 62 and the power strip housing 1, the element comprising the fuel distributing element 62 and the power strip can be secured in common, for instance to an intake tube or cylinder head of an engine. For pre-mounting of the fuel distributing element 62 and power strip, a through opening 76 is embodied, as shown in the exemplary embodiment, concentric with the blind bore 17, having an internal thread 18, of the fastening bush 13 in the fuel distributing element 62, by means of a through bush 77. The head of a screw 79, which is screwed into the internal thread 18 of the blind bore 17 of the power strip 1 and thus joins the power strip and the fuel distributing element 62 to one another, rests on a face end 78 of the through bush 77 remote from the power strip housing 1.

However, it is also possible to dispose the fuel injection valves 63 directly on an intake tube having receiving openings for fuel injection valves and connection necks and lines for fuel supply, or on a cylinder head also embodied in this way, and to provide electrical power to the fuel injection valve 63 jointly, with a power strip according to the invention.

The plug housings 2 of the power strip serve, with their first electrically conductive contact elements 5, to provide electrical power in common to the electrically actuatable units, for instance the fuel injection valves 63. To this end, the first electrically conductive contact elements 5 of the plug housings are electrically conductively connected by being plugged in to second electrically conductive contact elements 66 of the fuel injection valves 63. Because of the production-dictated tolerances in shape and location of the power strip housing 1, the plug housings 2, the fuel distributing element 62 and the fuel injection valves 63, offsets occur between the first electrically conductive contact elements 5 of the plug housings 2 and the second electrically conductive contact elements 66 of the fuel injection valves 63; in the process of joining the power strip and the fuel distributing element 62 these offsets can cause damage to the first and second electrically conductive contact elements 5, 66. To compensate for these offsets and prevent damage, the plug housings are freely movable relative to the power strip 1 prior to the joining process, which is made possible by the radial play 50, 51, 52 and the axial play 60, as well as by the elasticity of the damping element 55.

As a result of the process of joining the power strip and the fuel distributing element 62, the elastic damping element 55 is braced and elastically deformed between the face end 33 of the bottom of the power strip housing 1 and the face end 39 of the respective plug housing 2, so that the damping element 55 is under mechanical prestressing in the direction of the longitudinal axis 25 of the plug. The elastic damping element 55 thus clamped in place between the power strip housing 1 and the respective plug housing counteracts an independent motion of the plug housings 2 relative to the power strip housing 1 and the electrically actuatable units resulting from engine operation, in that the damping element 55 is deformed elastically.

With this damping of the relative motion between the plug housings 2 and the electrically actuatable units, wear at the contact points between the first electrically conductive contact elements 5 of the plug housings 2 and the second electrically conductive contact elements 66 of the electrically actuatable units is considerably reduced.

In the first exemplary embodiment of the power strip shown, the damping element 55, after the process of joining the power strip and the fuel distributing element 62, is braced between the plug housing 2 and the face end 33 of the bottom of the power strip housing 1 in such a way, and the damping element is embodied such, that the motions of the first electrically conductive contact elements 5 and electric conductors 6 incited by vibration of the engine during operation are also damped. To this end, the elastically deformed damping element 55 rest directly, by the circumference of through-insertion openings 58 that they have, on the first electrically conductive contact elements 5 of the plug housings 2 that pass through the through-insertion openings 58 and on the electrical conductors 6. The additional damping has the additional advantageous effect of reduced wear at the contact points between the first electrically conductive contact elements 5 of the plug housings 2 and the second electrically conductive contact elements 66 of the electrically excitable units, for instance the fuel injection valves 63.

Figure 6:
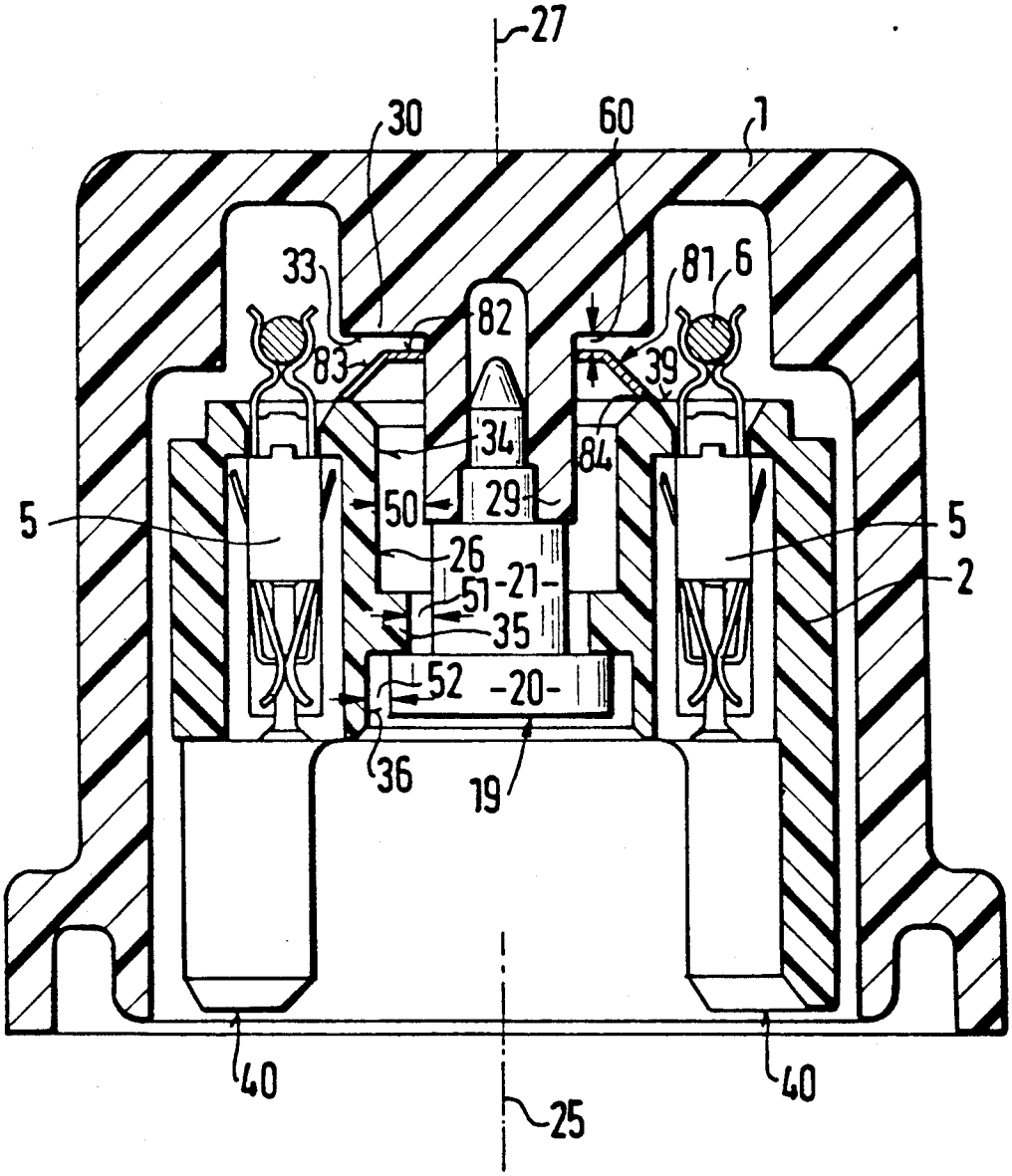
FIG. 6 shows an enlarged cross sectional view of a second exemplary embodiment of a power strip according to the invention.

A second exemplary embodiment of the invention is shown in FIG. 6. Elements that are the same and function the same are identified by the same reference numerals as in FIGS. 1-5.

A damping element in the form of a cup spring 81 is disposed between the face end 39 of the plug housing 2 and the stepped bottom 30 of the power strip housing 1. The cup spring 81 has a flat region 82 pointing radially inward toward the circumference of the middle protrusion 29, and an oblique spring region 83 extending radially outward, which toward the axial direction of the plug housing 2 rests, for instance by its outer end 84, on the face end 39 of the plug housing 2. It is also possible for the cup spring 81 to rest on the face end 39 of the plug housing 2 with its flat region 82, or for the cup spring 81 to have some other cross-sectional shape than that shown in FIG. 6.

In the direction of the longitudinal receiving axis 27, there is an axial play 60 present between the face end 33 of the bottom of the power strip housing 1 and the flat region 82 of the cup spring 81, and also between the face end 39 of the plug housing 2 and the circumference of the spring region 82 of the cup spring 81. As in the first exemplary embodiment, there are a radial play 50 in the radial direction between the stepped through opening 26 of the plug housing 2, in the first region 34 oriented toward the face end 33 of the bottom, and the circumference of the cylindrical middle protrusion 29; a radial play 51 between the inside clearance of the retaining shoulder 35 in the middle region 21 of the retaining element 19, and a radial play 52 between the head 20 of the retaining element 19 and the second region 36, surrounding the head 20, of the through opening 26. As a result of the radial plays 50, 51, 52 and the axial play 60 and the elasticity of the cup spring 81 acting as a damping element, the plug housing 2 is freely movable relative to the retaining element 19 and thus relative to the power strip housing 1, not only in the radial or horizontal direction but also at right angles to it, so that when the power strip is joined to the electrically actuatable units, offsets resulting from dimensional and positional tolerances between the first electrically conductive contact elements 5 of the plug housings 2 and the second electrically conductive contact elements 66 of the electrically actuatable units are compensated for, and damage is avoided.

After the process of joining the power strip, for instance to the fuel distributing element 62, the cup spring 81 is elastically deformed by its contact with the face end 33 of the bottom and the face end 39 of the plug, and thus experiences mechanical pre-stressing in the axial direction. The elastic deformability of the cup spring 81 makes the effective damping of the independent motions of the plug housing 2 generated as a result of engine operation relative to the power strip housing 1 and the electrically actuatable units possible, thus making it possible to reduce contact point wear at the first electrically conductive contact elements 5 of the plug housings 2 and the second electrically conductive contact elements 66 of the electrically actuatable units.

Figure 7:
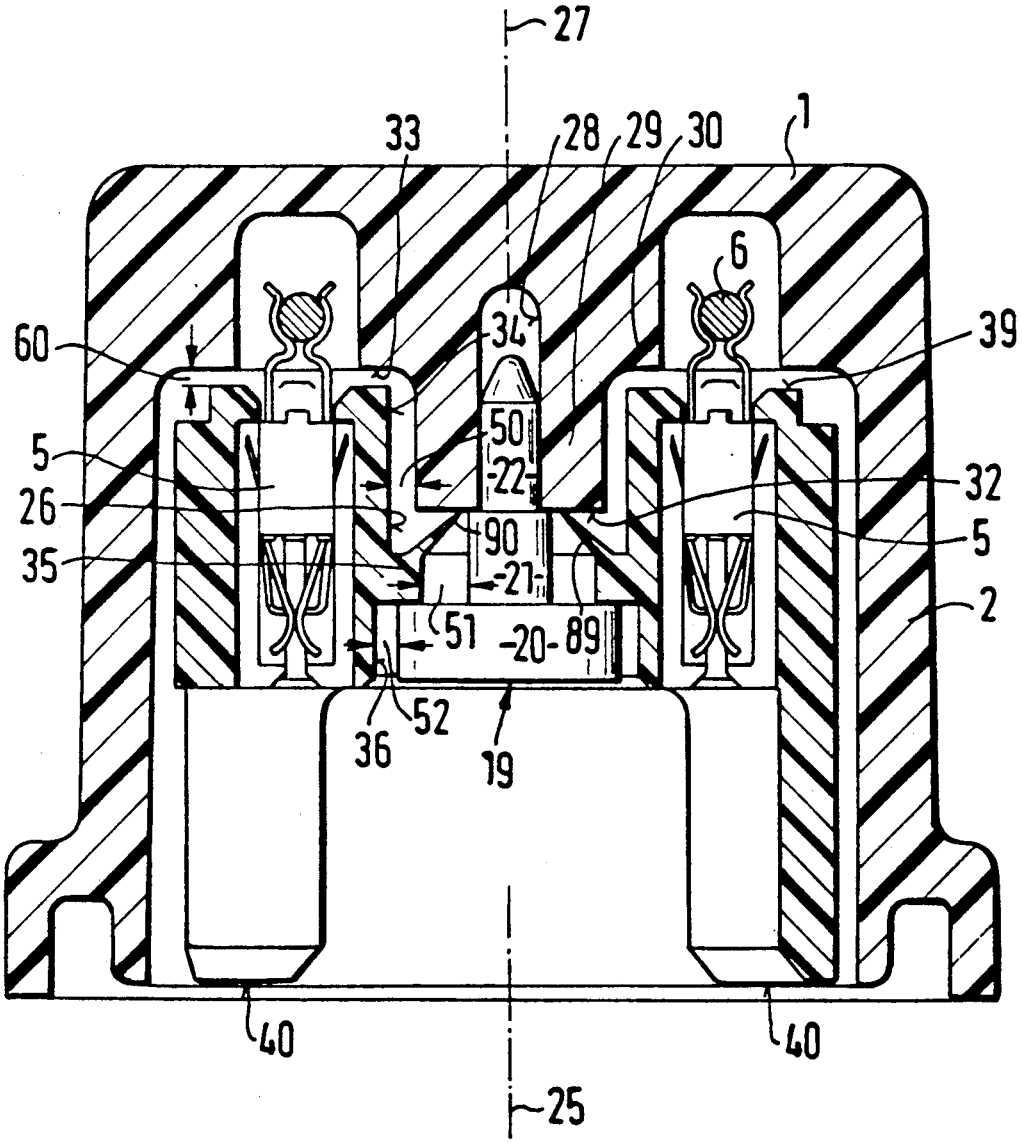
FIG. 7 shows an enlarged cross sectional view of a third exemplary embodiment of a power strip according to the invention.

FIG. 7 shows a third exemplary embodiment according to the invention, in which elements that are the same and function the same have the same reference numerals as in FIGS. 1-6.

A damping element 89 in the form of a cup spring or tongue is injected integrally with the retaining shoulder 35 of the plug housing 2, which for instance is of plastic, toward the middle protrusion 29 of the power strip housing 1. The damping element extends inward radially toward the longitudinal axis 25 of the plug and on the outside is joined to the retaining shoulder 35 of the plug housing 2. Radially inwardly, the damping element 89 in the form of a cup spring or tongue is shaped oriented toward the middle protrusion 29 in the axial direction of the face end 32 and rests on the face end 32, for instance by its inner end 90. The inside clearance of the damping element 89 on its inner end 90 has a markedly greater diameter, however, than the middle region 21 of the retaining element 19 secured in the blind bore 28 of the middle protuberance 29. The damping element 89 may be embodied as at least two individual tongues or may be annular, like a cup spring. Between the face end 33 of the bottom of the power strip housing 1 and the face end 39 of the plug housing 2, an axial play 60 is for instance provided in the direction of the longitudinal plug axis 25. Besides the free mobility of the plug housing 2 in the direction of the longitudinal plug axis 25 relative to the power strip housing 1 in the vertical direction, based on the elasticity of the damping element 89 in the axial direction and on the axial play 60, the power strip according to the third exemplary embodiment also enables free mobility of the plug housing 2 relative to the power strip housing 1 in the horizontal direction, that is, extending at right angles to the longitudinal axis 25 of the plug or the longitudinal receiving axis 27. For this purpose, there is a radial play 50 in the radial direction between the stepped through bore 26 of the plug housing 2, in the first region 34 oriented toward the face end 33 of the bottom of the power strip housing 1, and the circumference of the cylindrical middle protuberance 29; a radial play 51 between the clear span of the retaining shoulder 35 and the middle region 21 of the retaining element 19; and a radial play 52 between the head 20 of the retaining element 19 and the second region 36, surrounding the head 20, of the through opening 26. Problem-free joining with a compensation for offset between the power strip and the electrically actuatable units thus becomes possible. The damping element 89 in the form of a cup spring or tongue, which cooperates with the face end 32 of the middle protuberance 29 and after the joining process is elastically deformed in the axial direction, by its axial deformability damps the independent motions, generated by engine operation, of the respective plug housing 2 relative to the power strip housing 1, particularly in the direction of the longitudinal axis 25 of the plug or the longitudinal receiving axis 27, and thus reduces contact point wear at the first electrically conductive contact elements 5 of the plug housings 2 and the second electrically conductive contact elements 66 of the electrically actuatable units.

Unlike the third exemplary embodiment shown, however, it is also possible for the applicable damping element 89 to be integrally formed onto the face end 32 of the middle protuberance 29 and to have its free end engage the retaining shoulder 35. Moreover, the damping element 89 can naturally also be embodied as a slab molded of elastic material, as in the first exemplary embodiment of FIGS. 1-5, or as a cup spring, as in the second exemplary embodiment of FIG. 6.

Figure 8:
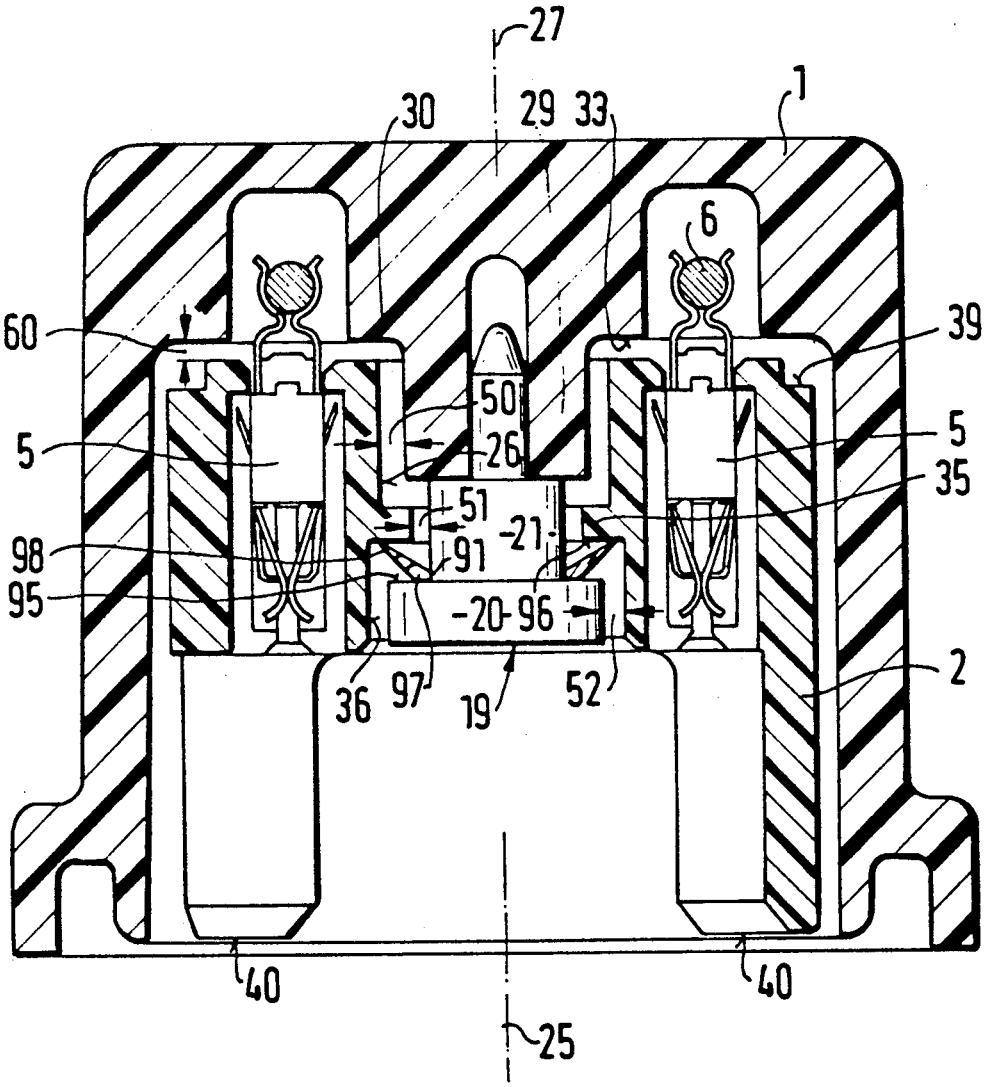
FIG. 8 shows an enlarged cross sectional view of a fourth exemplary embodiment.

A fourth exemplary embodiment according to the invention is shown in FIG. 8; identical parts that function the same are identified by the same reference numerals as in FIGS. 1-7. As in the third exemplary embodiment, the fourth exemplary embodiment has an axial play 60 in the direction of the longitudinal plug axis 25 or longitudinal receiving axis 27, between the respective plug housing 2 and the face end 33 of the bottom of the power strip housing 1, and radial plays 50, 51, 52 at right angles to it, between the stepped through bore 26 of the plug housing 2 and the circumference of the cylindrical middle protuberance 29 or the retaining element 19. Between a first bearing surface 95 of the head 20 of the retaining element 19, oriented toward the middle protuberance 29, and a second bearing surface 96 of the retaining shoulder 35 of the plug housing 2, oriented toward the head 20, there is a cup spring 97 acting as a damping element and for instance of metal. With its outer end 98, the cup spring 97 rests for instance on the second bearing surface 96 of the retaining shoulder 35 with play relative to the second region 26, and by its inner end, engaging the circumference of the middle region 21, it rests on the first bearing surface 95 of the head 20. However, it is also possible for the cup spring 97, by its outer end 98, to rest on the first bearing surface 95 of the head 20 and with its inner end 91 to rest on the second bearing surface 96 of the retaining shoulder 35. The plug housing 2 and the bottom 30 of the power strip housing 1 are embodied such that after the process of joining the power strip, for instance to a fuel distributing element 62, the cup spring 97 is fastened between the first bearing surface 95 and the second bearing surface 96, having been elastically deformed in the direction of the longitudinal plug axis 25. Because of the elastic deformability of the cup spring 97 acting as a damping element, the independent motions, generated during engine operation, of the applicable plug housing 2 relative to the power strip housing 1 are damped, particularly in the direction of the longitudinal axis 25 of the plug or the longitudinal receiving axis 27, and thus the contact point wear at the first electrically conductive contact elements 5 of the plug housings 2 and at the second electrically conductive contact elements 66 of the electrically actuatable units is reduced.

Naturally, the damping element 97 may be embodied as a slab molded of elastic material, as in the first exemplary embodiment of FIGS. 1-5 or as a damping element integrally formed on in the form of a cup spring or tongue to the retaining shoulder 35, as in the third exemplary embodiment of FIG. 7.

Figure 9:
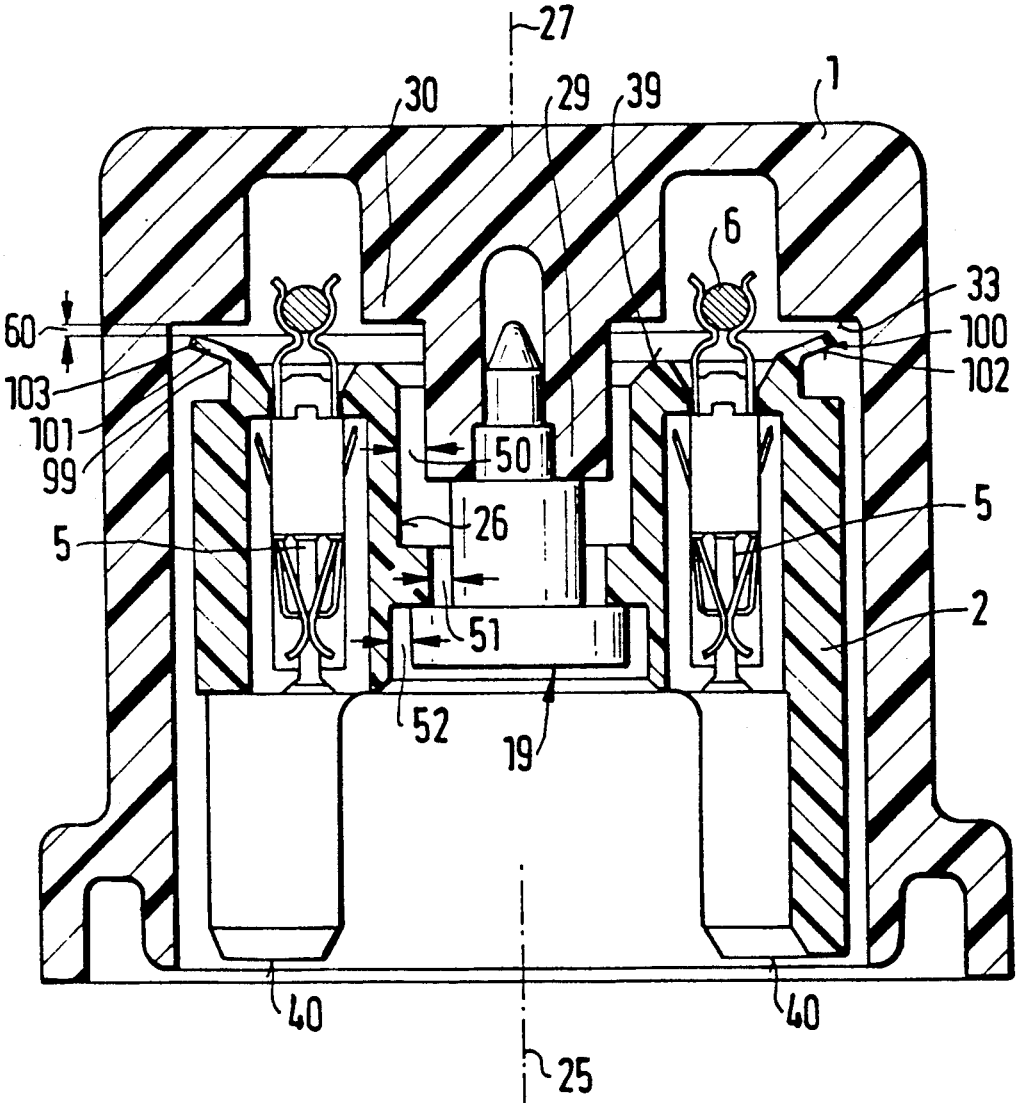
FIG. 9 shows an enlarged cross sectional view of a fifth exemplary embodiment of a power strip according to the invention.

FIG. 9 shows a further, fifth exemplary embodiment of the invention. Elements that are the same and function the same are provided with the same reference numerals as in FIGS. 1-8. In the radial direction—as in the other exemplary embodiments of the invention there are radial plays 50, 51, 52 between the stepped through bore 26 of the plug housing 2 and the circumference of the cylindrical middle protrusion 29 of the power strip housing 1 or retaining element 19, to assure free mobility of the plug housing 2 relative to the power strip housing 1.

A damping element 100 in the form of a cup spring or tongue is jointly injection molded, for instance by its inner end 101, to an outer rim 99 of the end face 39 of the plug housing 2, which is for instance made of a plastic. The damping element 100 may be embodied as at least two individual tongues, or annularly like a cup spring. The oblique spring region 102 of the damping element 100 in the form of a cup spring or tongue extends from the inner end 101 to its outer end 103 in the axial direction, oriented toward the end face 33 of the bottom of the power strip housing 1. An axial play 60, which assures free mobility of the respective plug housing 2 relative to the power strip housing 1, is provided between the outer end 103 of the damping element 100 and the face end 33 of the bottom of the power strip housing 1. The axial play 60 is great enough, and the plug housing 2 or bottom 30 of the power strip housing 1 is embodied such, that after the process of mounting the electrically actuatable units and the power strip, the applicable damping element 100, which is integrally injection molded to the plug housing 2, rests directly on the face end 33 of the power strip housing 1 and is slightly deformed elastically. If the plug housing 2 vibrates independently as a result of engine operation, this independent vibration is damped by the deformability of the damping element 100, and the contact wear between the first electrically conductive contact elements 5 and the plug housings 2 and the second electrically conductive contact elements 66 of the electrically actuatable units is thereby reduced.

However, it is also possible for the various damping elements 100 in the form of cup springs or tongues to be jointly or integrally injection molded to the face end 33 of the bottom of the power strip housing 1 and to cooperate with the various face ends 39 of the respective plug housings 2.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United States is:

1. A power strip for supplying electrical power in common to a plurality of electrically actuatable units, especially fuel injection valves of internal combustion engines, having a power strip housing, plug housings disposed on the power strip housing, said plug housings are floatingly movable relative to the power strip housing in a direction of their longitudinal plug axes and at right angles thereto, first electrically conductive contact elements disposed in said plug housings, which can be connected by plugging with second electrically conductive contact elements of each of said electrically actuatable units, said power strip includes one damping element (55; 81; 89; 97; 100) each disposed between the various plug housings (2) and the power strip housing (1) in the direction of the longitudinal plug axes (25) of the plug housings.

2. A power strip for supplying electrical power in common to a plurality of electromagnetically actuatable fuel injection valves of internal combustion engines, having a power strip housing, plug housings disposed on the power strip housing, said plug housings are floatingly movable relative to the power strip housing in a direction of their longitudinal plug axes and at right angles thereto, first electrically conductive contact elements disposed in said plug housings which can be connected by plugging with second electrically conductive contact elements of each of said fuel injection valves, said fuel injection valves disposed in valve receiving openings of a fuel distributing element, embodied spaced apart from one another, and each receiving opening, each encompassing one fuel injection valve, is open at both ends and communicates with at least one fuel line that extends in the fuel distributing element, with which distributing element the power strip is connected in such a manner that the receiving openings are covered and the fuel injection valves are retained therein, said power strip includes one damping element (55; 81; 89; 97; 100) each disposed between the various plug housings (2) and the power strip housing (1) in the direction of the longitudinal plug axes (25) of the plug housings.

3. A power strip as defined by claim 1, in which one damping element each (55; 81; 100) is disposed between a face end (33) of the bottom of the power strip housing (1) oriented toward the plug housings (2) and each face end (39) of the bottom of the various plug housings (2) oriented toward the face end 33.

4. A power strip as defined by claim 2, in which one damping element each (55; 81;.100) is disposed between a face end (33) of the bottom of the power strip housing (1) oriented toward the plug housings (2) and each face end (39) of the bottom of the various plug housings (2) oriented toward the face end 33.

5. A power strip as defined by claim 3, in which one tongue-like damping element (100) is integrally formed onto each of the face ends (39) of the various plug housings (2), oriented toward the bottom face end (33) of the power strip housing (1).

6. A power strip as defined by claim 4, in which one tongue-like damping element (100) is integrally formed onto each of the face ends (39) of the various plug housings (2), oriented toward the bottom face end (33) of the power strip housing (1).

7. A power strip as defined by claim 3, in which one cup-shaped damping element (100) is integrally formed onto each of the face ends (39) of the various plug housings (2), oriented toward the bottom face end (33) of the power strip housing (1).

8. A power strip as defined by claim 4, in which one cup-shaped damping element (100) is integrally formed onto each of the face ends (39) of the various plug housings (2), oriented toward the bottom face end (33) of the power strip housing (1).

9. A power strip as defined by claim 1, in which a number of middle protuberances (29) corresponding to the number of plug housings (2) is provided on the power strip housing (1), which protuberances protrude outward, oriented toward the respective plug housing (2) and the plug housings (2) have a stepped through opening (26), extending concentrically with the respective longitudinal plug axis (25), in each of which openings a retaining shoulder (35) with a reduced clearance is embodied, wherein one damping element (55; 89) is disposed between each retaining shoulder (35) and each middle protuberance (29).

10. A power strip as defined by claim 2, in which a number of middle protuberances (29) corresponding to the number of plug housings (2) is provided on the power strip housing (1), which protuberances protrude outward, oriented toward the respective plug housing (2) and the plug housings (2) have a stepped through opening (26), extending concentrically with the respective longitudinal plug axis (25), in each of which openings a retaining shoulder (35) with a reduced clearance is embodied, wherein one damping element (55; 89) is disposed between each retaining shoulder (35) and each middle protuberance (29).

11. A power strip as defined by claim 9, in which a tongue-shaped damping element (89) is integrally formed onto each retaining shoulder (35) and cooperates with a face end (32) of the middle protuberance (29), oriented toward the retaining shoulder (35).

12. A power strip as defined by claim 10, in which a tongue-shaped damping element (89) is integrally formed onto each retaining shoulder (35) and cooperates with a face end (32) of the middle protuberance (29), oriented toward the retaining shoulder (35).

13. A power strip as defined by claim 9, in which a cup-shaped damping element (89) is integrally formed onto each retaining shoulder (35) and cooperates with a face end (32) of the middle protuberance (29), oriented toward the retaining shoulder (35).

14. A power strip as defined by claim 10, in which a cup-shaped damping element (89) is integrally formed onto each retaining shoulder (35) and cooperates with a face end (32) of the middle protuberance (29), oriented toward the retaining shoulder (35).

15. A power strip for supplying electrical power in common to a plurality of electrically actuatable units, especially fuel injection valves of internal combustion engines, having a power strip housing and plug housings disposed on the power strip housing, said plug housings are floatingly movable relative to the power strip housing in the direction of their longitudinal plug axes and at right angles thereto, said plug housings have a opening extending concentrically with the respective longitudinal plug axis, in each of which opening one retaining shoulder having a reduced clearance is embodied, first electrically conductive contact elements disposed in said plug housings, which can be connected by plugging to second electrically conductive contact elements of each of said fuel injection valves, retaining elements, one of each of which serves to retain a single plug housing on the power strip housing, and each of which has a head, a middle region and an end point, with which the retaining elements are disposed in a blind bore of a middle protuberance of the power strip housing, one damping element (55; 97) each is disposed between a first bearing surface (95) oriented toward the middle protrusion (29), the head (20), the retaining element (19), and a second bearing surface (96) of the retaining shoulder (35), oriented toward the head (20) of the retaining element (19).

16. A power strip as defined by claim 1, in which the damping element (55) is embodied from an elastic material.

17. A power strip as defined by claim 2, in which the damping element (55) is embodied from an elastic material.

18. A power strip as defined by claim 9, in which the damping element (55) is embodied from an elastic material.

19. A power strip as defined by claim 10, in which the damping element (55) is embodied from an elastic material.

20. A power strip as defined by claim 15, in which the damping element (55) is embodied from an elastic material.

21. A power strip as defined by claim 1, in which the damping element is embodied in the form of a cup spring (81; 89; 97).

22. A power strip as defined by claim 2, in which the damping element is embodied in the form of a cup spring (81; 89; 97).

23. A power strip as defined by claim 3, in which the damping element is embodied in the form of a cup spring (81; 89; 97).

24. A power strip as defined by claim 4, in which the damping element is embodied in the form of a cup spring (81; 89; 97).

25. A power strip as defined by claim 15, in which the damping element is embodied in the form of a cup spring (81; 89; 97).

* * * * *